US009797695B2

(12) United States Patent
Gelfert

(10) Patent No.: US 9,797,695 B2
(45) Date of Patent: Oct. 24, 2017

(54) CARTRIDGE

(71) Applicant: RUAG Ammotec GmbH, Fürth (DE)

(72) Inventor: Stephan Gelfert, Ichenhausen (DE)

(73) Assignee: RUAG Ammotech GmbH, Furth (DE)

( * ) Notice: Subject to any disclaimer, the term of this patent is extended or adjusted under 35 U.S.C. 154(b) by 0 days.

(21) Appl. No.: 15/031,464

(22) PCT Filed: Oct. 24, 2014

(86) PCT No.: PCT/EP2014/072866

§ 371 (c)(1),
(2) Date: Apr. 22, 2016

(87) PCT Pub. No.: WO2015/059282

PCT Pub. Date: Apr. 30, 2015

(65) Prior Publication Data

US 2016/0252332 A1 Sep. 1, 2016

(30) Foreign Application Priority Data

Oct. 25, 2013 (DE) ..... 10 2013 017 672

(51) Int. Cl.
*F42B 5/26* (2006.01)
*F42B 5/067* (2006.01)
(Continued)

(52) U.S. Cl.
CPC ..... *F42B 5/067* (2013.01); *F42B 5/025* (2013.01); *F42B 14/02* (2013.01)

(58) Field of Classification Search
CPC ..... F42B 5/025; F42B 5/067; F42B 14/02
See application file for complete search history.

(56) References Cited

U.S. PATENT DOCUMENTS 2,872,864 A 2/1959 Barnes et al.
3,720,169 A 3/1973 Johnson et al.
(Continued)

FOREIGN PATENT DOCUMENTS

EP 1 774 251 B1 8/2009
EP 2 253 924 A2 11/2010
(Continued)

OTHER PUBLICATIONS

International Search Report for PCT/EP2014/072866 dated Jan. 5, 2015; English translation submitted herewith (7 Pages).
(Continued)

*Primary Examiner* — Gabriel Klein
(74) *Attorney, Agent, or Firm* — Fitch Even Tabin & Flannery, LLP

(57) ABSTRACT

The invention relates to a cartridge having a projectile, and a case which is mounted on the projectile from behind and which has a case mouth at the front end, wherein the projectile has a tip, and at the rear this tip merges into a circumferential front guide band which defines the outside diameter of the projectile, and directly adjoining this front guide band in the direction of the projectile base, a circumferential case mouth receiving space which extends in the axial direction of the projectile and in which the case mouth engages is situated in the projectile. In order to reduce the twistless freebore to a minimum and build up the gas pressure early during firing, it is proposed that an exposed portion of the case mouth receiving space extending in the axial direction of the projectile is situated between the front guide band and the case mouth; i.e., the case mouth does not completely fill the case mouth receiving space in the direction of the nose of the projectile.

11 Claims, 2 Drawing Sheets

Figure 1A:
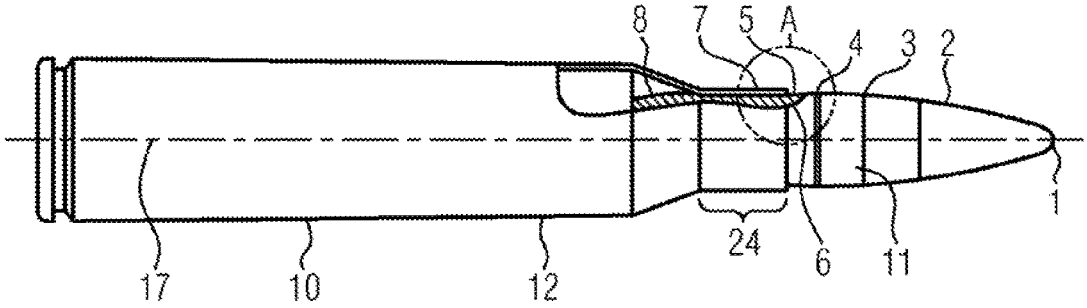

(51) Int. Cl.
*F42B 5/02* (2006.01)
*F42B 14/02* (2006.01)

(56) References Cited

U.S. PATENT DOCUMENTS 4,938,146 A * 7/1990 Gunther ..... F42B 12/10
102/430
5,767,438 A * 6/1998 Lang ..... F42B 5/025
102/439

FOREIGN PATENT DOCUMENTS

GB 576 726 A 4/1946
NL 7 203 827 A 9/1973

OTHER PUBLICATIONS

Written Opinion of the International Search Authority dated Jan. 5, 2015 (5 Pages).

* cited by examiner

CARTRIDGE

CROSS-REFERENCE TO RELATED APPLICATIONS

This application is a U.S. national phase application filed under 35 U.S.C. §371 of International Application No. PCT/EP2014/072866, filed Oct. 24, 2014, designating the United States, which claims priority from German Patent Application No. 10 2013 017 672.7, filed Oct. 25, 2013, which are hereby incorporated herein by reference in their entirety for all purposes.

The invention relates to a cartridge having a projectile, and a case which is mounted on the projectile from behind and which has a case mouth at the front end, wherein the projectile has a tip, and at the rear this tip merges into a circumferential front guide band which defines the outside diameter of the Projectile, and directly adjoining this front guide band in the direction of the projectile base, a circumferential case mouth receiving space which extends in the axial direction of the projectile and in which the case mouth engages is situated in the projectile.

This type of projectile is known from EP 1 774 251 B1.

The object of the invention is to improve a cartridge according to the preamble of Claim 1 in such a way that the twistless freebore is reduced to a minimum during firing. Likewise, the aim is to build up the gas pressure early. A further aim, among others, is to seal off the case mouth with respect to the projectile against any form of moisture.

This object is achieved according to the invention by the features of Claim 1.

Due to an exposed portion of the case mouth receiving space which extends in the axial direction of the projectile being situated between the front guide band and the case mouth, i.e., the case mouth not completely filling the case mouth receiving space in the direction of the nose of the projectile, the front guide band is shifted forward toward the tip, as the result of which the twistless freebore is reduced to a minimum. In addition, a receiving space is thus created which may be filled with a sealing means, thus sealing off the case mouth with respect to the projectile against any form of moisture.

It is thus preferred for the exposed portion of the case mouth receiving space to be sealed off with a sealing means, for example a lacquer.

In one embodiment, the projectile tip merges via one or more shapes into the front guide band, i.e., on the outside diameter of the projectile, in an ogival or conical manner. The transitional shape at the guide band from the tip to the guide band optimally has a conical shape at the angle of the transition cone of the cartridge chamber. The increase in the outside diameter of the projectile thus achieved reduces the twistless freebore and builds up the gas pressure. The conical shape at the guide band brings about centering of the projectile with respect to the barrel bore axis. Centering produced in this way results in improved precision.

The exposed portion of the case mouth receiving space may merge into the front guide band in a concave, convex, or linear manner. If the exposed portion of the case mouth receiving space merges linearly into the front guide band, this linear transition preferably extends at an angle of less than or equal to 16 degrees with respect to the projectile axis. This angle of ≤16° with respect to the projectile axis is preferred for aerodynamic reasons.

One embodiment is characterized in that from the radially lowest location in the case mouth receiving space, i.e., the field diameter or smaller, the shape of the projectile toward the rear transitions via one or more shapes to the diameter of the projectile or smaller in a concave, convex, or linear manner. The front guide band in the outside diameter of the projectile allows a smaller design of the rear part of the projectile, since this part is not necessary for the pressure build-up. In addition, the barrel load (frictional resistance and associated barrel heating and barrel deposits) are thus also reduced. The projectile is ideally shaped in such a way that it is suitable for sealing off the case mouth with respect to the projectile and for pinching the case mouth.

In one design, a receiving space containing a material that produces a tracer upon initiation is situated at the rear of the projectile. This is referred to as a tracer projectile or a tracer cartridge.

In one embodiment, a borehole which is coaxial with respect to the projectile axis is provided in the projectile, the borehole being open toward the projectile tip, and a projectile core made of tungsten or tungsten carbide is situated in the borehole, and the borehole is closed by a projectile tip insert made of titanium or zirconium, the outer shell of the projectile tip insert being a part of the tip of the projectile. This is referred to as an armor-piercing incendiary (API) projectile or API cartridge.

In principle, the embodiment with the guide band shifted to the front is transferable to other types of projectiles. Examples of other types of projectiles are armor-piercing (AP) projectiles, partial fragmentation projectiles, full metal jacket projectiles, monolithic projectiles, deformation projectiles, and others.

The invention is explained in greater detail below with reference to the figures.

Figure 1B:
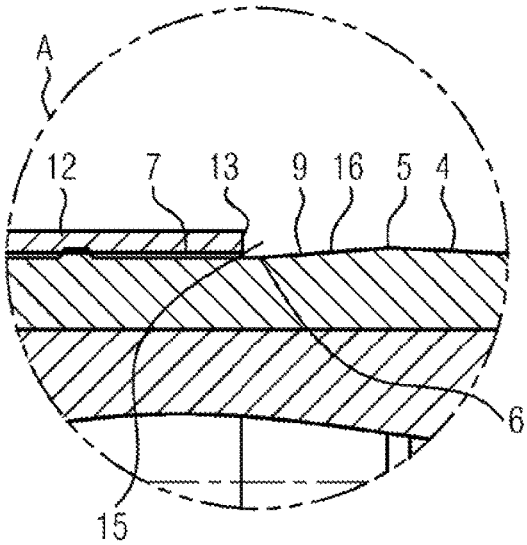

FIG. 1*a* shows a cartridge 10 according to the invention, and FIG. 1*b* shows an enlarged detail A from FIG. 1*a*.

Figure 2:
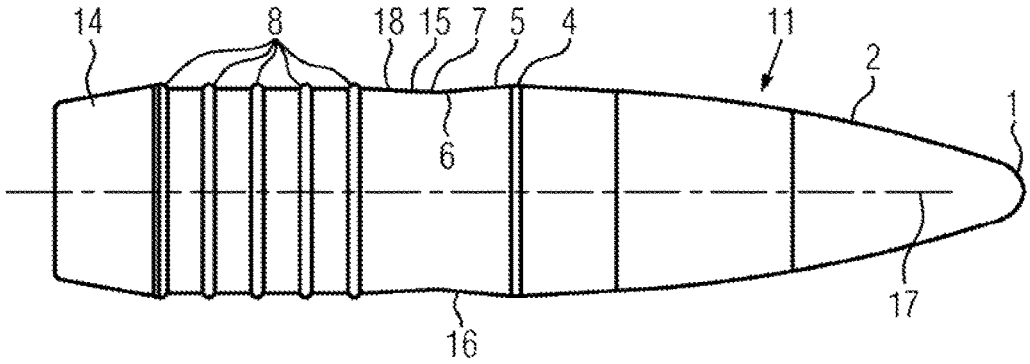

FIG. 2 shows the projectile 11 according to FIGS. 1*a* and 1*b*, but without the case 12.

Figure 3:
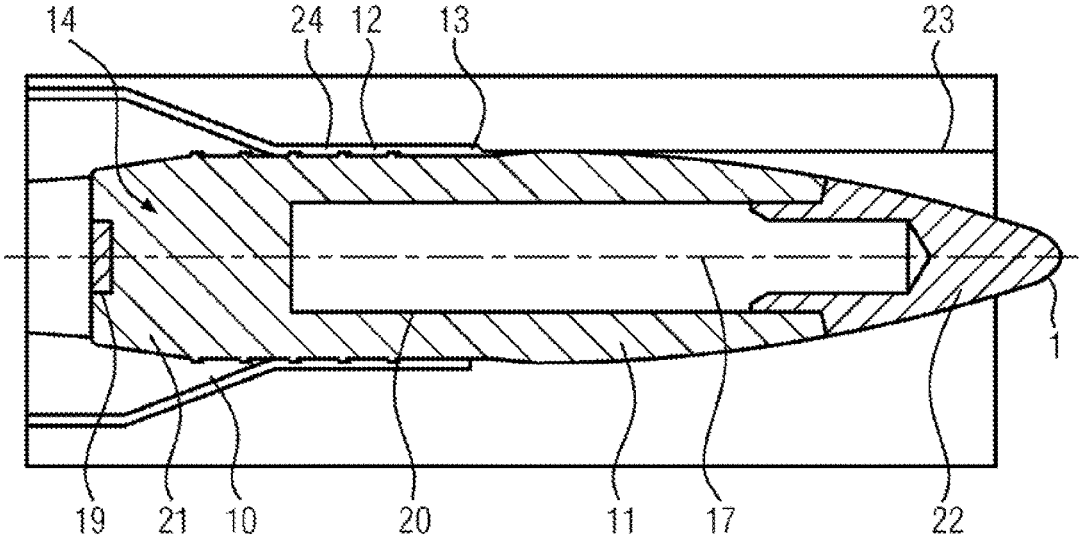

FIG. 3 shows the cross section of a cartridge 10 according to the invention that is inserted into a barrel 23 of a weapon. The same subject matter is denoted by identical reference numerals in all the figures.

The cartridge 10 is made up of a projectile 11 and a case 12 which is mounted on the projectile 11 from behind and which has a case mouth 13 at the front end, wherein the projectile 11 has a tip 1, and at the rear this tip 1 merges into a circumferential front guide band 4 which defines the outside diameter of the projectile. Directly adjoining this front guide hand 4 in the direction of the projectile base 14, a circumferential case mouth receiving space 15, which extends in the axial direction of the projectile 11 and in which the case mouth 13 engages, is situated in the projectile 11. An exposed portion 16 of the case mouth receiving space 15 extending in the axial direction of the projectile 11 is situated between the front guide band 4 and the case mouth 13. Therefore, the case mouth 13 does not completely fill the case mouth receiving space 15 in the direction of the nose of the projectile 11. The case mouth 13 thus fills only a portion of the case mouth receiving space 15, and the remaining portion is situated outside the case 12.

Due to the front guide band 4, also referred to below as the outside diameter of the projectile, being shifted to the front on the projectile 11, the twistless freebore is reduced to a minimum during firing. Likewise, due to the front guide band 4, the as pressure is built up early, thus making it possible to design the area behind the front guide band 4 with a smaller diameter. A decrease in the diameter reduces the projectile friction in the barrel 23. Less heat energy is generated due to the lower friction, thus delaying the heating of the barrel 23. The precision is increased and is maintained for a longer time. The reduced projectile friction results in increased velocity, which produces a longer trajectory. As a result of the exposed portion 16 of the case mouth receiving space 15, the case mouth 13 and an area 7 of the case mouth receiving space 15 may be easily sealed off from any form of moisture, for example by means of a lacquer in this exposed portion 16 of the case mouth receiving space 15.

The projectile tip 1 may be round, flat, or pointed.

The projectile tip 1 extends via one or more shapes in an ogival 2 or conical manner, such as concave, convex, or linear 3, up to the outside diameter of the projectile, i.e., up to the front guide band 4. The transitional shape at the guide band from the tip to the guide band is optimally conical at the angle of the transition cone of the cartridge chamber. The conical shape at the guide band brings about centering of the projectile with respect to the barrel bore axis. Centering produced in this way results in improved precision.

The increase in the outside diameter of the projectile thus achieved is intended to reduce the twistless freebore and build up the gas pressure. The outside diameter of the projectile or the front guide band 4 in any caliber is defined by the largest permissible diameter of the projectile. In CIP member states, this is the value "G1" for a "maxi cartridge."

In a departure from the outside diameter mentioned above, the defined maximum permissible diameter of the projectile is used in the military and governmental sectors. The tolerance range at the front guide band 4 is −0.1 mm with respect to the permissible diameter of the projectile.

The outside diameter of the projectile or the axial extension of the front guide band is maintained only temporarily, and for aerodynamic reasons gradually tapers linearly 6 to a diameter corresponding to the field diameter 6 or smaller.

The distance between the frontmost guide band 4 and the field diameter 6 depends on the caliber, with different transition lengths. However, the front guide band 4 is positioned in such a way that preferably little or no twistless freebore is present. It is essential to have a distance between the case mouth 13 and the frontmost guide band 4.

The field diameter 6 at the lowest point of the case mouth receiving space 15 is defined in each caliber. In CIP member states, this is the value "F" for "mini cartridge chamber." In a departure from the field diameter 6 mentioned above, the minimum permissible field diameter of the projectile is used in the military and governmental sectors. The tapering shape may extend in a concave, convex, or linear manner. An angle 9 of ≤16° with respect to the projectile axis 17 is preferred for aerodynamic reasons. For radii, the angle of the resulting straight lines between the front guide band 4 and the field diameter 6 is used.

From the field diameter 6 or smaller, the shape of the projectile extends via one or more shapes to the rear in a concave, convex, or linear 7 manner (see FIG. 1*b*) on the diameter of the projectile. The projectile 7 is ideally shaped in such a way that it is suitable for sealing off the case mouth 21 and for pinching the case 12.

The projectile 11 is cylindrical or is provided with rear guide bands 8 in the area of the case neck 24.

A receiving space 19 at the rear of the projectile 11 may contain a material which produces a tracer. This is referred to as a tracer projectile.

A borehole 20 which is coaxial with respect to the projectile axis 17, is preferably provided in the projectile 11 (see FIG. 3), the borehole being open toward the projectile tip 1, and a projectile core 21 made of tungsten or tungsten carbide is situated in the borehole 20, and the borehole 20 is closed by a projectile tip insert 22 made of titanium or zirconium, the outer shell of the projectile tip insert 22 being a part of the tip 1 of the projectile 11.

The invention claimed is:

1. A cartridge comprising a projectile and a case, a front end of the case having a case mouth, the projectile having a tip and a circumferential front guide band, the tip merging into the front guide band, the projectile having a circumferential case mouth receiving space directly adjoining the front guide band and extending in an axial direction of the projectile toward a base of the projectile, the projectile having a circumferential rear guide band between the case mouth receiving space and the base of the projectile, the front guide band and the rear guide band defining an outside diameter of the projectile, the case mouth engaging the projectile in the case mouth receiving space, an exposed portion of the case mouth receiving space extending in the axial direction of the projectile being situated between the front guide band and the case mouth, and the case mouth not completely filling the case mouth receiving space in the direction of the tip of the projectile.

2. The cartridge according to claim 1, characterized in that the exposed portion of the case mouth receiving space is sealed off with a sealant.

3. The cartridge according to claim 1, characterized in that the tip merges via one or more shapes into the front guide band on the outside diameter of the projectile, in an ogival or conical manner.

4. The cartridge according to claim 1, characterized in that the exposed portion of the case mouth receiving space merges into the front guide band in a concave, convex, or linear manner.

5. The cartridge according to claim 4, characterized in that the exposed portion of the case mouth receiving space merges linearly into the front guide band at an angle of less than or equal to 16 degrees with respect to an axis of the projectile.

6. The cartridge according to claim 1, characterized in that the projectile transitions from a radially lowest location in the case mouth receiving space toward a rear of the projectile, via one or more shapes, in a concave, convex, or linear manner, to the outside diameter of the projectile.

7. The cartridge according to claim 1, characterized in that a receiving space containing a material that produces a tracer upon initiation is situated at a rear of the projectile.

8. The cartridge according to claim 1, characterized in that a borehole, which is coaxial with respect to an axis of the projectile, is provided in the projectile, the borehole being open toward the tip of the projectile, and a projectile core made of tungsten carbide is situated in the borehole, and the borehole is dosed by a projectile tip insert made of titanium, an outer shell of the projectile tip insert being a part of the tip of the projectile.

9. The cartridge according to claim 2, characterized in that the sealant comprises a lacquer.

10. The cartridge according to claim 6, characterized the radially lowest location in the case mouth receiving space is a field diameter or smaller.

11. A cartridge comprising:

a projectile including a tip, a circumferential front guide band, and a circumferential rear guide band, the projectile further including a circumferential case mouth receiving space extending in an axial direction of the projectile toward a base of the projectile, the case mouth receiving space being disposed between the front guide band and the rear guide band, and the front guide band and the rear guide band defining an outside diameter of the projectile, and a case, a front end of the case including a case mouth, the case mouth engaging the projectile in the case mouth receiving space, the case mouth not completely covering the case mouth receiving space, and an exposed portion of the case mouth receiving space extending between the front guide band and the case mouth.

* * * * *